US011761263B1

(12) United States Patent
Xu et al.

(10) Patent No.: US 11,761,263 B1
(45) Date of Patent: Sep. 19, 2023

(54) BALANCE FORCE COMPONENT FOR CORDLESS WINDOW SHADES

(71) Applicant: Cheng Xu, Dongguan (CN)

(72) Inventors: Cheng Xu, Dongguan (CN); Jiangyong Chen, Qingyuan (CN); Tong Wang, Yanbian Korean Autonomous Prefecture (CN)

( * ) Notice: Subject to any disclaimer, the term of this patent is extended or adjusted under 35 U.S.C. 154(b) by 0 days.

(21) Appl. No.: 18/097,188

(22) Filed: Jan. 13, 2023

(51) Int. Cl.
*E06B 9/60* (2006.01)
*E06B 9/44* (2006.01)

(52) U.S. Cl.
CPC ..... *E06B 9/60* (2013.01); *E06B 9/44* (2013.01)

(58) Field of Classification Search
CPC ..... E06B 9/44; E06B 9/322; E06B 9/60
See application file for complete search history.

(56) References Cited

U.S. PATENT DOCUMENTS

| | | | | |
|---|---|---|---|---|
| 8,919,419 | B2 * | 12/2014 | Mullet | E06B 9/62 160/310 |
| 10,407,980 | B2 | 9/2019 | Hall | |
| 10,988,981 | B2 * | 4/2021 | Lei | E06B 9/324 |
| 11,649,674 | B2 * | 5/2023 | Valkenburg | E06B 9/78 160/300 |
| 2016/0356081 | A1 * | 12/2016 | Sung | E06B 9/306 |
| 2017/0218694 | A1 | 8/2017 | Sung | |

* cited by examiner

*Primary Examiner* — Beth A Stephan
(74) *Attorney, Agent, or Firm* — Georgi Korobanov

(57) ABSTRACT

The present application provides a balance force component of a cordless window shade, which relates to the technical field of window shade components. A balance force component of a cordless window shade, comprising a windows shade tube, a core tube component is respectively provided at both ends inside the window shade tube, a deceleration component is respectively provided at the outer ends of the core tube component, and the outer ends of the deceleration components are respectively provided with a mounting component, the core tube component comprises an outer bracket, a number of clamping holes are equidistantly arranged on one side of the outer bracket, both sides of the outer wall of the outer bracket are provided with limiting grooves, and the outer ends of the inner wall of the outer bracket are provided with tooth grooves.

7 Claims, 2 Drawing Sheets

BALANCE FORCE COMPONENT FOR CORDLESS WINDOW SHADES

TECHNICAL FIELD

The present application relates to the technical field of window shade components, in particular to a balance force component for cordless window shades.

BACKGROUND

Window shades are made of cloth, hemp, yarn, aluminum plates, wood chips, metal materials, etc., and have the functions of sunshading, heat insulation and adjusting indoor light. Cloth window shades are divided into cotton gauze, polyester cloth, polyester-cotton blended, cotton-linen blended, non-woven fabrics, etc. according to the material. Different materials, textures, colors, patterns, etc. are combined to form different styles of window shades, which match different styles of interior design window shades.

Electric window shades require wiring, high cost, and troublesome construction, while manual window shades are troublesome to operate, time-consuming and labor-intensive, and the ropes are likely to cause safety hazards to children.

in view of this, the existing problem is researched and improved, and a cordless window shade spring balance component is provided, which has a reasonable structural design. The present application is built into the window shade rod, and the internal balance of the gravity of the window shade can be realized through the force storage of the spring, and the window shade can be retracted with only a small external force, which improves the experience of using the window shade. The purpose of this technology is to solve problems and improve practical value.

SUMMARY

Aiming at the deficiencies of the prior art, the present application provides a balance force component for cordless window shades, which solves the problems that electric window shades require wiring, high cost and troublesome construction, manual window shade operation is laborious, and ropes are likely to cause safety hazards to children.

In order to achieve the above purpose, the present application is achieved through the following technical solutions: A balance force component for a cordless window shade, comprising a window shade tube, wherein a core tube component is respectively provided at both ends inside the window shade tube, a deceleration component is respectively provided at outer ends of the core tube component, and outer ends of the deceleration components are respectively provided with a mounting component;

the core tube component comprises an outer bracket, a number of clamping holes are equidistantly arranged on one side of the outer bracket, both sides of the outer wall of the outer bracket are provided with limiting grooves, and the outer ends of the inner wall of the outer bracket are provided with tooth grooves, the outer bracket is provided with a core shaft, and one side of the core shaft is equidistantly provided with a plurality of fixing columns, and the fixing columns are fixedly connected to an inside end of the coil spring, and an outside end of the coil spring passes through the corresponding clamping hole.

Preferably, the deceleration component comprises an end block and a fixed bracket, the fixed bracket is fixedly connected to the outer end of the core shaft, and a plurality of planetary gears are arranged on the fixed bracket, wherein the outer ends of the fixed brackets are provided with end blocks, and the middle parts of the inner ends of the end blocks are fixedly connected with sun gears, and the sun gears are meshed with the corresponding planetary gears, and the planetary gears are meshed with the corresponding tooth grooves, and a insertion hole is arranged in the middle of the outer end of the end block, and both sides of the end block are provided with second through holes, and both side outer ends of the outer bracket are provided with first through holes.

Preferably, both sides of the inner wall of the window shade tube are provided with fixed ribs, and the fixed rib is slidably connected to the corresponding limit groove.

Preferably, the mounting component comprises L-shaped fixing foot, and the inner middle part of the L-shaped fixing foot is fixedly connected with an insertion block, and the insertion block is engaged with the corresponding insertion hole, and the L-shaped fixing foot is provided with fixing holes.

Preferably, a pin is arranged in the first through hole, and the pin passes through the first through hole and extend into the corresponding second through hole.

Preferably, the number of the coil spring, the clamping hole and the installation groove of the core shaft correspond to each other, and the window shade tube is provided with window shade cloth.

Preferably, the outer ends of the coil springs are all V-shaped, and adhere to the outer wall of the outer bracket.

Working principle: Put the core tube component in the window shade tube, when the window shade is pulled, the window shade tube drives the outer bracket to rotate. Through the deceleration of the planetary gear, the core shaft is driven to rotate, and there is a speed difference between the core shaft and the outer bracket, thereby driving the spring to store force. By matching different elastic springs and different planetary gear reduction ratios, different pulling forces can be output to match the gravity of window shades of different sizes and materials. In this way, the balance between the gravity and the elastic force of the spring can be realized at any position of the window shade, thereby achieving the effect of the window shade hovering.

The present application provides a balance force component for cordless window shades. It has the following beneficial effects:

The present application uses the coil spring to accumulate the torsion force inside the core tube component, directly drives the window shade tube, the frictional resistance is extremely small, cooperates with the planetary gear for deceleration, and through the coil springs with different elastic forces and different planetary gear reduction ratios, different pulling forces can be output, to match the gravity of window shades of different sizes and materials, the window shades can be retracted at any position, the balance of gravity can be achieved to improve the experience of using window shades, and the trouble of wiring electric window shades and the safety hazards caused by ropes to children can be avoided. The present application can realize the cordless control of the window shades, and is very simple to retract and unfold, and has no exposed parts at the same time, and has a beautiful and simple appearance.

Figure 1:
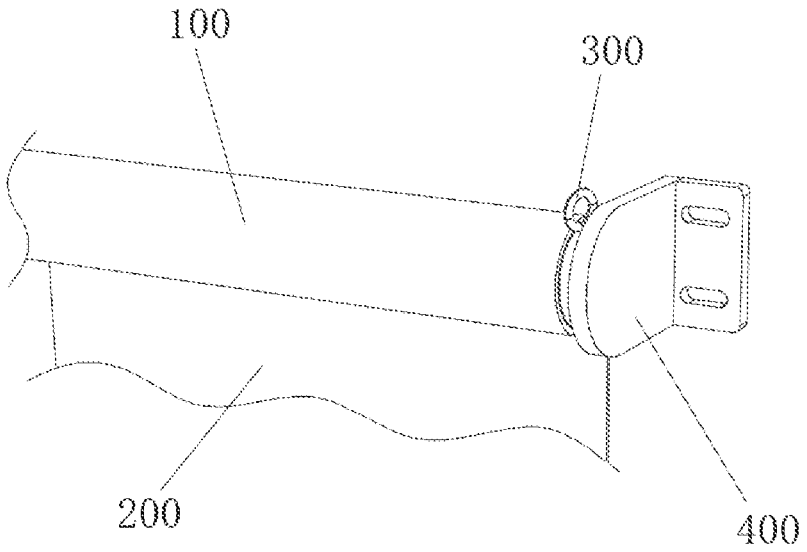
FIG. 1 is a schematic diagram of installation effect of the present application.
Figure 2:
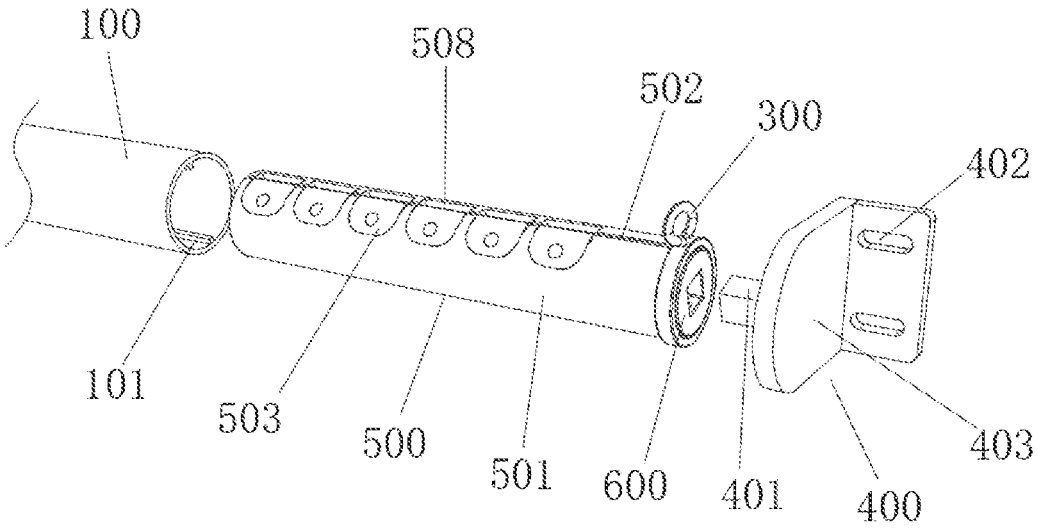
FIG. 2 is a structural split diagram of the present application.
Figure 3:
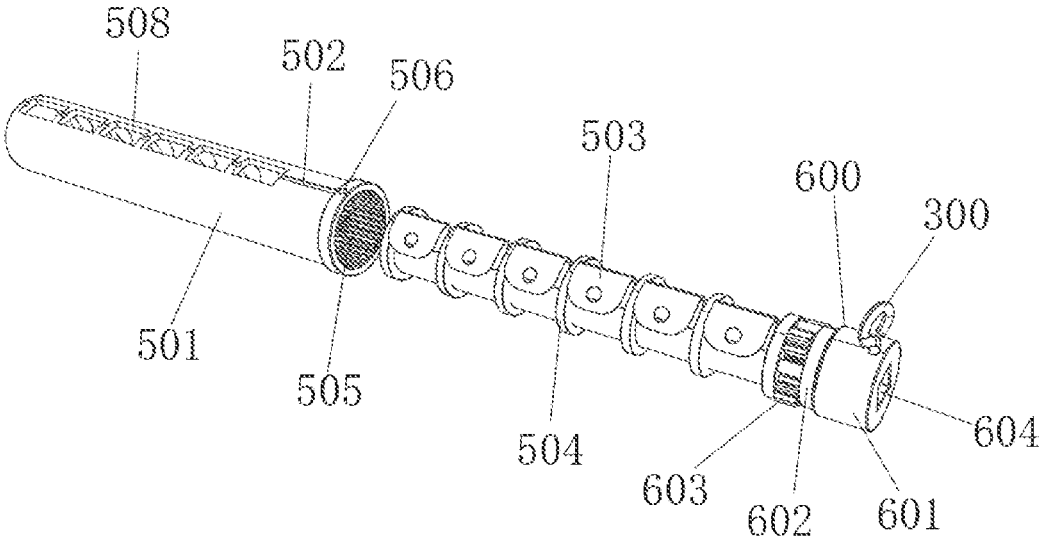
FIG. 3 is a structural split diagram of the core tube component of the present application.
Figure 4:
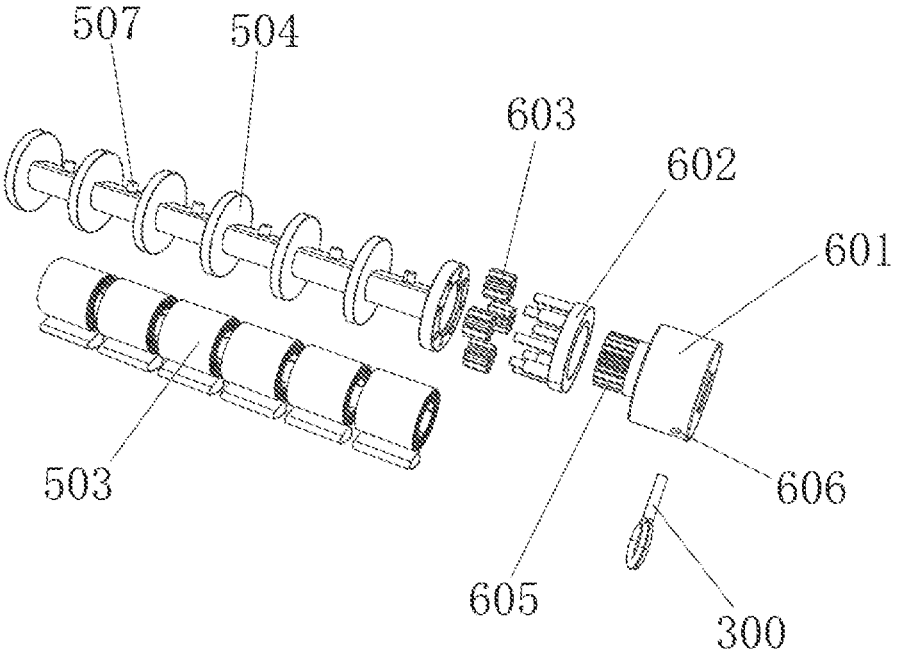
FIG. 4 is a structural exploded view of the core shaft and the deceleration component of the present application.

Reference signs:

100. Window shade tube; 101. Fixed rib; 200. Window shade cloth; 300, Pin; 400. Mounting component; 401. Insertion block; 402. Fixing hole; 403. L-shaped fixed foot; 500. Outer bracket; 502. Limiting groove; 503. Coil spring; 504. Core shaft; 505. Tooth groove; 506. First through hole; 507. Fixing column; 508. Clamping hole; 602. Fixed bracket; 603. Planetary gear; 604. Insertion hole; 605, Sun gear; 606. Second through hole.

DETAILED DESCRIPTION

The technical solutions in the embodiments of the present application will be clearly and completely described below in conjunction with the drawings in the embodiments of the present application. Apparently, the described embodiments are only some of the embodiments of the present application, not all of them. Based on the embodiments in the present application, all other embodiments obtained by persons of ordinary skill in the art without making creative efforts belong to the protection scope of the present application.

Embodiment

As shown in FIGS. 14, the embodiment of the present application provides a balance force component for cordless window shades, comprising a window shade tube 100, wherein a core tube component 500 is respectively provided at both ends inside the window shade tube 100, a deceleration component 600 is respectively provided at outer ends of the core tube component, and outer ends of the deceleration components 600 are respectively provided with a mounting component 400.

The core tube component 500 comprises an outer bracket 501, a number of clamping holes 508 are equidistantly arranged on one side of the outer bracket 501, both sides of the outer wall of the outer bracket 501 are provided with limiting grooves 502, and the outer ends of the inner wall of the outer bracket 501 are provided with tooth grooves 505, the outer bracket 501 is provided with a core shaft 504, and one side of the core shaft 504 is equidistantly provided with a plurality of fixing columns 507, and the fixing columns 507 are fixedly connected to an inside end of the coil spring 503, and an outside end of the coil spring 503 passes through the corresponding clamping hole 508. The number of the coil spring 503 can be adjusted according to the size of the window shade cloth 200 and the material with different weights.

The deceleration component 600 comprises an end block 601 and a fixed bracket 602, the fixed bracket 602 is fixedly connected to the outer end of the core shaft 504, and a plurality of planetary gears 603 are arranged on the fixed bracket 602, wherein the outer ends of the fixed brackets 602 are provided with end blocks 601, and the middle parts of the inner ends of the end blocks 601 are fixedly connected with sun gears 605, and the sun gears 605 are meshed with the corresponding planetary gears 603, and the planetary gears 603 are meshed with the corresponding tooth grooves 505, and a insertion hole 604 is arranged in the middle of the outer end of the end block 601, and both sides of the end block 601 are provided with second through holes 606, and both side outer ends of the outer bracket 501 are provided with first through holes 506.

When the window shade cloth 200 is pulled, the window shade tube 100 drives the outer bracket 501 to rotate, and the planetary gear 603 decelerates to drive the core shaft 504 to rotate, and there is a speed difference between the core shaft 504 and the outer bracket 501, thereby bringing the coil spring 503 to store force.

The planetary gear 603 transmits the rotating force of the outer bracket 501 to the core shaft 504 through the sun gear 605, and drives the core shaft 504 to rotate, and the fixed bracket 602 and the core shaft 504 together play the role of fixing the planetary gear 603.

Both sides of the inner wall of the window shade tube 100 are provided with fixed ribs 101, and the fixed rib 101 is slidably connected to the corresponding limit groove 502. During installation, the core tube component 500 is inserted between the fixed ribs 101 at both ends of the window shade tube 100 through the limiting groove 502, so that the window shade tube 100 and the core tube component 500 rotate synchronously.

The mounting component 400 comprises an L-shaped fixing foot 403, and the inner middle part of the L-shaped fixing foot 403 is fixedly connected with an insertion block, and the insertion block 401 is engaged with the corresponding insertion hole 604, and the L-shaped fixing foot 403 is provided with fixing holes 402. Through the fixing hole 402, the L-shaped fixing foot 403 can be fixed on the wall with the hole through the expansion bolt.

A pin 300 is arranged in the first through hole 506, and the pin 300 passes through the first through hole 506 and extends into the corresponding second through hole 606. The pin 300 is pulled out after the window shade is installed, and is usually used to keep the elastic force of the coil spring 503 during transportation to prevent the coil spring 503 from losing its elastic force.

The number of the coil spring 503, the clamping hole 508 and the installation groove of the core shaft 504 correspond to each other, and the window shade tube 100 is provided with window shade cloth 200. By matching different elastic springs 503 and different planetary gear 603 reduction ratios, different pulling forces can be output to match the gravity of window shade cloth 200 of different sizes and materials. In this way, the balance between the gravity and the elastic force of the coil spring 503 can be realized at any position of the window shade cloth 200, so as to realize the cordless control of the window shade cloth 200, and it is very simple to retract and unwind.

The outer ends of the coil springs 503 are all V-shaped, and adhere to the outer wall of the outer bracket 501. The coil spring 503 is made of a stainless steel strip with a thickness of only about 0.1 mm through mechanical winding, and is formed by heat treatment, with stable elastic force and long service life. Through the rewinding process of the coil spring 503, the torque is accumulated inside the core tube component 500 to directly drive the window shade tube 100 with extremely small frictional resistance.

Although the embodiments of the present application have been shown and described, those skilled in the art can understand that various changes, modifications and substitutions can be made to these embodiments without departing from the principle and spirit of the present application. The scope of the application is defined by the claims appended hereto and their equivalents.

What is claimed is:

1. A balance force component for a cordless window shade, comprising a window shade tube (100), wherein a core tube component (500) is respectively provided at both ends inside the window shade tube (100), a deceleration component (600) is respectively provided at outer ends of each of the core tube components, and outer ends of the deceleration components (600) are respectively provided with a mounting component (400), each of the core tube components (500) comprises an outer bracket (501), a number of clamping holes (508) arranged in a straight line are equidistantly arranged on an outer wall of the outer bracket (501), both ends of the outer bracket (501) are provided with a limiting groove (502), and the outer ends of an inner wall of the outer bracket (501) are provided with tooth grooves (505) formed on the outer wall, the outer bracket (501) is provided with a core shaft (504), and the core shaft (504) is equidistantly provided with a plurality of fixing columns (507), and the fixing columns (507) are fixedly connected to an inside of a coil spring (503), and an outside end of the coil spring (503) passes through one of the corresponding clamping holes (508).

2. The balance force component for a cordless window shade according to claim 1, wherein each of the deceleration component (600) comprises an end block (601) and a fixed bracket (602), the fixed bracket (602) is fixedly connected to the outer end of the core shaft (504), and a plurality of planetary gears (603) are arranged on the fixed bracket (602), wherein the outer ends of the fixed brackets (602) are provided with end blocks (601), and a middle-part of an inner end of each of the end blocks (601) are fixedly connected with sun gears (605), and the sun gears (605) are meshed with the corresponding planetary gears (603), and the planetary gears (603) are meshed with the corresponding tooth grooves (505), and an insertion hole (604) is arranged in the middle of the outer end of the end block (601), and both sides of the end block (601) are provided with second through holes (606), and both side outer ends of the outer bracket (501) are provided with first through holes (506).

3. The balance force component for a cordless window shade according to claim 2, wherein both of the ends of the window shade tube (100) are provided with a fixed rib (101) formed on an inner wall of the window shade tube, and one of the fixed ribs (101) is slidably connected to one of the limit grooves (502).

4. The balance force component for a cordless window shade according to claim 1, wherein each of the mounting components (400) comprises an L-shaped fixing foot (403), and an inner middle part of the L-shaped fixing foot (403) is fixedly connected with an insertion block, and the insertion block (401) is engaged with the insertion hole (604), and the L-shaped fixing foot (403) is provided with fixing holes (402).

5. The balance force component for a cordless window shade according to claim 2, wherein a pin (300) is arranged in one of the first through holes (506), and the pin (300) passes through the one of first through holes (506) and extends into one of the second through holes (606).

6. The balance force component for a cordless window shade according to claim 1, wherein the window shade tube (100) is provided with window shade cloth (200).

7. The balance force component for a cordless window shade according to claim 1, wherein the outer ends of the coil springs (503) are all V-shaped, and adhere to the outer wall of the outer bracket (501).

* * * * *